US006371106B1

(12) United States Patent
Lambertson

(10) Patent No.: US 6,371,106 B1
(45) Date of Patent: Apr. 16, 2002

(54) EXHAUST HOOD APPARATUS AND METHOD OF INSTALLATION

(75) Inventor: Ted Lambertson, Cameron Park, CA (US)

(73) Assignee: Ventilation Technology, Rancho Cordova, CA (US)

( * ) Notice: Subject to any disclaimer, the term of this patent is extended or adjusted under 35 U.S.C. 154(b) by 0 days.

(21) Appl. No.: 09/545,389

(22) Filed: Apr. 7, 2000

Related U.S. Application Data

(60) Provisional application No. 60/128,767, filed on Apr. 9, 1999.

(51) Int. Cl.[7] ..... F24C 15/20
(52) U.S. Cl. ..... 126/299 R; 126/299 D
(58) Field of Search ..... 126/299 R, 299 D, 126/300, 299 E; 55/DIG. 55; 454/49, 67, 65, 66

(56) References Cited

U.S. PATENT DOCUMENTS 2,962,955 A * 12/1960 Bernstein ..... 126/299 D
2,993,428 A * 7/1961 Wermager ..... 126/299 D
3,130,661 A * 4/1964 Fischer ..... 126/299 D
3,941,039 A * 3/1976 Kinney ..... 126/299 D
4,887,587 A * 12/1989 Deutsch ..... 126/299 D
5,522,377 A * 6/1996 Fritz ..... 126/299 R

FOREIGN PATENT DOCUMENTS

GB 2229378 * 9/1990 ..... 126/299 R

* cited by examiner

*Primary Examiner*—James C. Yeung
(74) *Attorney, Agent, or Firm*—John P. O'Banion

(57) ABSTRACT

An industrial air exhaust hood for the collection and filtering of air that is to be exhausted through ductwork. The inventive exhaust hood apparatus may be installed within a building in an installation process that does not require the creation and use of a factory customized exhaust hood configured for the specific ductwork within the building for which it is to be installed. The exhaust hood contains a hood enclosure free of obstructive structures which thereby allows for the cutting and welding of the hood enclosure to the ductwork, whereupon filter retention devices and filters are installed. The result is an exhaust hood apparatus that can be installed on-site in a single process without the need of drawings and hood customization.

17 Claims, 15 Drawing Sheets

EXHAUST HOOD APPARATUS AND METHOD OF INSTALLATION

CROSS-REFERENCE TO RELATED APPLICATIONS

This application claims priority from U.S. provisional application serial No. 60/128,767 filed on Apr. 9, 1999.

BACKGROUND OF THE INVENTION

1. Field of the Invention

The invention generally pertains to an industrial exhaust hood and more particularly to an exhaust hood apparatus and installation method wherein all installation steps may be completed on site.

2. Description of the Background Art

Exhaust hoods are typically required above hot-food preparation stations to capture, filter, and exhaust the fumes created underneath containing grease and other by-products of the cooking process. An exhaust hood generally comprises a hood enclosure within which is retained a set of filters through which air is drawn into a plenum and passed through to a duct opening within the hood and out through ductwork within the building which routes the fumes past a fan driven vacuum source to be exhausted.

One of the difficulties encountered when installing conventional exhaust hoods has been with welding an attachment between the duct opening of the exhaust hood with the ductwork of the building. Exhaust hoods generally employ a custom collar which is welded to the exhaust hood as per installer provided drawings. In order that the exhaust hood be customized correctly with the duct collar, the installer must make precise measurements of the intended installation location and the exhaust hood and produce a drawing which depicts how the duct work for the exhaust hood is to be positioned within the hood. This requires the installer to perform at least one pre-installation visit to the site of intended installation. Once created, the drawing is sent to the hood manufacturer, wherein the drawing is interpreted and an exhaust hood is customized with a custom collar assembly welded in the manner prescribed in the drawings. Measuring, drawing, and customizing are costly, time consuming steps which have been necessary to assure that the exhaust hood gets properly secured to the ductwork. In addition, if the drawings or the factory makes any significant error with regards to dimensioning or positioning of the duct hole and collar, the whole exhaust hood assembly will need to make a return trip to the factory and the installation process further delayed. Errors such as these can substantially increase the overall cost of the exhaust hood.

In an attempt to circumvent these problems, a few installers have attempted to weld duct connections onto conventional exhaust hoods. However the construction of a conventional exhaust hood makes the task of welding in the duct work very difficult, and at times nearly impossible. The result is that many exhaust hood installations either have an incomplete weld or no welding at all. Installations with incomplete duct welding pose a safety hazard and generally do not meet with applicable standards.

Therefore, a need exists for an exhaust hood wherein the installer can easily perform all the installation operations in the field, including proper welding of the duct to the exhaust hood, without the need to create drawings and a requisite need to work with the factory on configuring a custom installation. The present invention satisfies these needs, as well as others, and overcomes the deficiencies of previously developed exhaust hood devices.

BRIEF SUMMARY OF THE INVENTION

The current invention is an exhaust hood apparatus and installation method that allows for field installation of an off-the-shelf exhaust hood by a service person in the field. The exhaust hood contains an exterior hood structure which forms a partial enclosure which is constructed generally for mounting to one or more walls and a ceiling, and is configured on site with filters and filter retention mechanisms. The inventive exhaust hood apparatus can be installed on-site in a single process without the need of drawings and hood customization. During the installation process, the assembly of the filter-related mechanisms can be deferred as necessary to provide access that allows cutting of a duct hole and the subsequent welding of the duct to the exhaust hood.

An object of the invention is to eliminate the need for an installer to take precise measurements and create a drawing of the duct attachment to the exhaust hood.

Another object of the invention is to eliminate the requirement of having a factory welded duct collar.

Another object of the invention is to provide better access within the exhaust hood that allows the installer to create the duct work cutout and to completely weld the duct work to the hood.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 18. It will be appreciated that the apparatus may vary as to configuration and as to details of the parts without departing from the basic concepts as disclosed herein.

Figure 1:
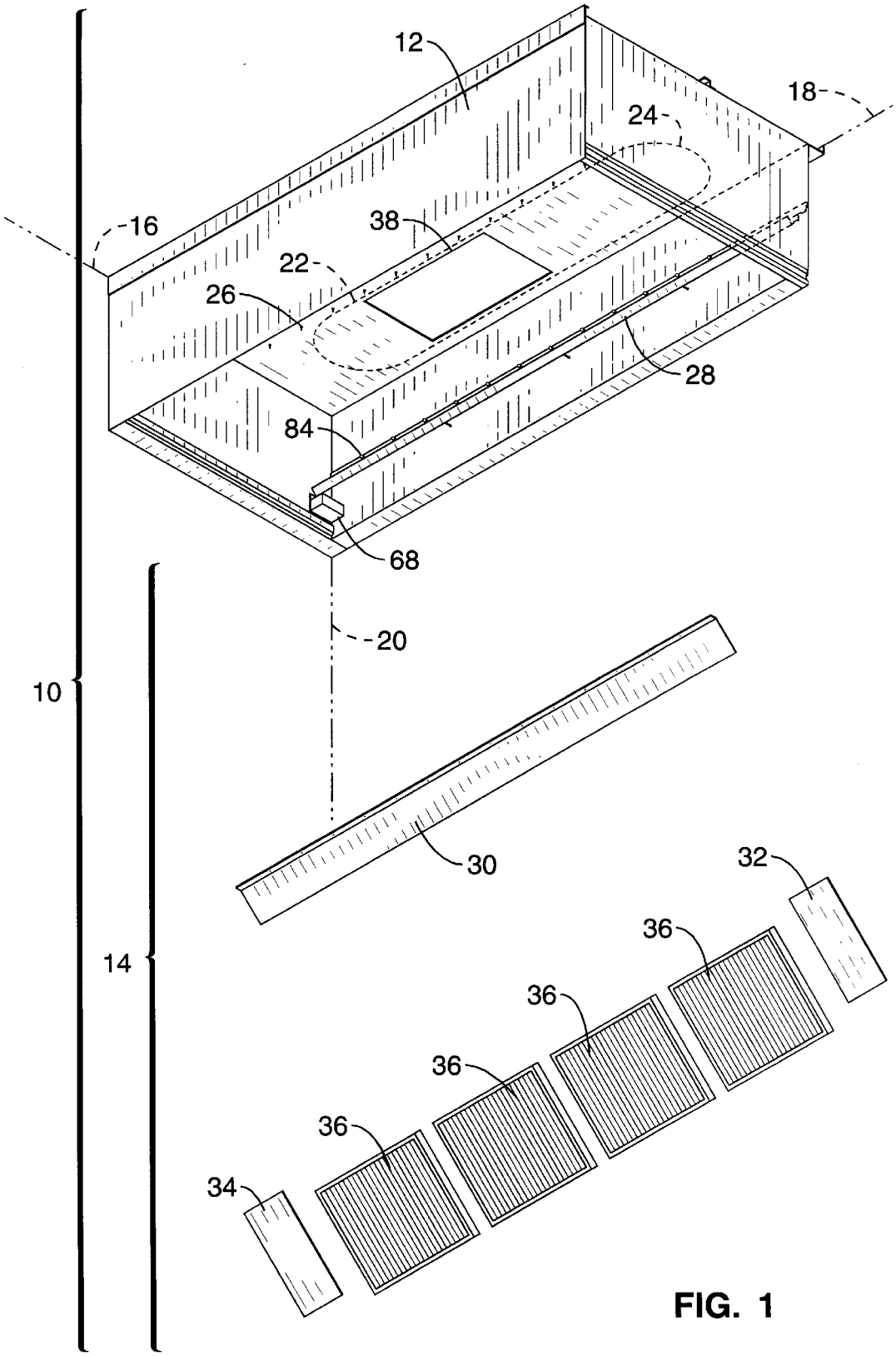
FIG. 1 is a partially-exploded view of final installation of the exhaust hood according to the present invention.

Following is a description of how the inventive exhaust hood is installed within a building structure containing an exhaust duct. A detailed breakdown of the construction of the embodied exhaust hood follows thereafter. The exhaust hood 10 of FIG. 1 is shown comprising a hood enclosure 12 along with a filter configuration part grouping 14 which is shown ready for attachment. The enclosure is shown in the process of being mounted against a ceiling in a corner between two walls, ostensibly above where a cooking apparatus, or similar, is to be placed. Shown to provide mounting references for a typical installation, are broken lines depicting a horizontal juncture 16 between a wall and a ceiling, a horizontal juncture 18 of a rear-wall with the ceiling, and vertical juncture 20 between the two walls. It should be recognized that the exhaust hood of the present invention can be implemented for installation upon various combinations of wall and ceiling structures without departing from the inventive principles set forth.

The exhaust hood is shown with a typical duct cutout region 22 into which a rectangular duct opening 38 has been cut for the attachment thereto of duct work (not shown) which is welded to the hood enclosure (with or without a duct collar). It will be appreciated that the duct cutout may be of various shapes and sizes, the semicircular end 24 of the duct cutout region 22 illustrates this pictorially. Clear access within the interior of the hood enclosure 12 is available within this embodiment of the invention because no structures are configured within the interior of the exhaust hood that restrict access to the duct opening 38 for welding. Once the duct has been secured to the exhaust hood, a filter configuration part grouping 14 may be attached which provides functional configuration of the exhaust hood.

As already described, exhaust hoods have been typically produced as custom units by exhaust hood manufacturers to fit a specific set of ductwork as per the specifications provided by the installer. However, the inventive exhaust hood described can be taken directly to the site and connected immediately with the ductwork of the building; no ductwork drawings or factory customization of this exhaust hood device is required. The internal parts of the exhaust hood can be shipped loose to reduce shop labor expenses and simplify field installation.

The embodiment of the exhaust hood as shown in FIG. 1 already has a number of the hood features pre-installed. A pre-configured lower-row of mounting studs (not shown) retains a lower filter retention bracket 28, which may be removed to provide additional installation access space if required. A grease collection cup 68 is also shown attached. It can be easily seen that access to the duct opening 38 is unrestricted whereas the installer can properly fit and weld the duct work to the hood enclosure 12. After connection of the hood enclosure 12 to the ductwork (not shown), the remainder of the exhaust hood within the filter configuration part grouping 14 can be built up. The upper filter retention bracket 30 is assembled over a pre-configured upper-row of mounting studs 26 and retained by fasteners (not shown). Panels are attached for blocking air flow that would otherwise circumnavigate the air filters, a right side panel 32 and left side panel 34 are attached therebetween top and bottom brackets. It should be recognized that a variety of air blocking panels could be employed within the exhaust hood depending on the configuration of the filters and the retention structure. Finally a set of four UL filters 36 are installed. Each of the filters 36 shown herein is a UL approved baffle type filter measuring 16"×20"×2". The following section details construction details for the exhaust hood embodiment described which allows for proper installation on site without custom factory welding of duct collars.

Figure 2:
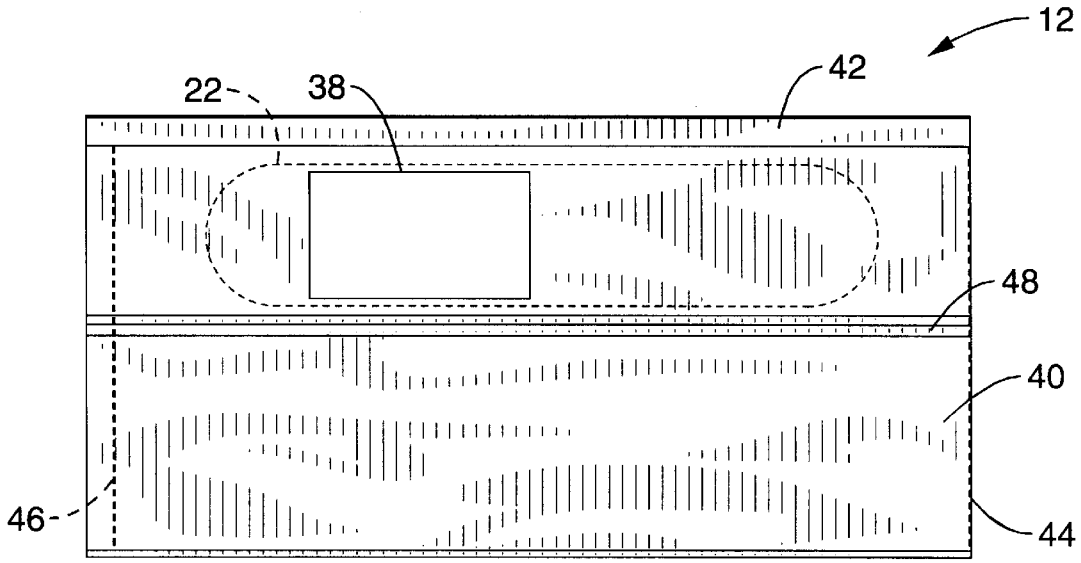
FIG. 2 is a plan view of the exhaust hood apparatus according to the invention showing a duct opening within the typical area from which duct openings are cut.
Figure 3:
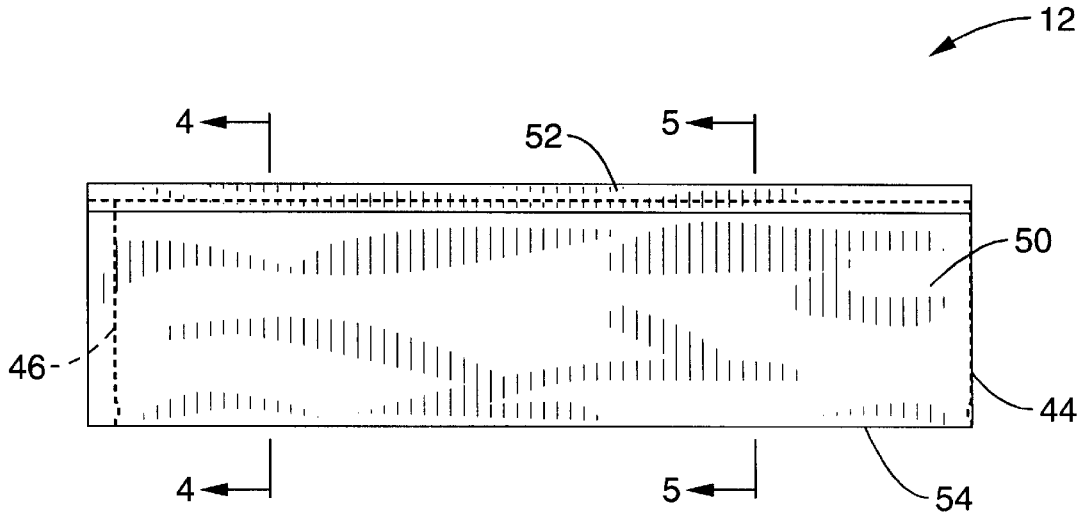
FIG. 3 is an elevation view of the exhaust hood apparatus of FIG. 2.
Figure 4:
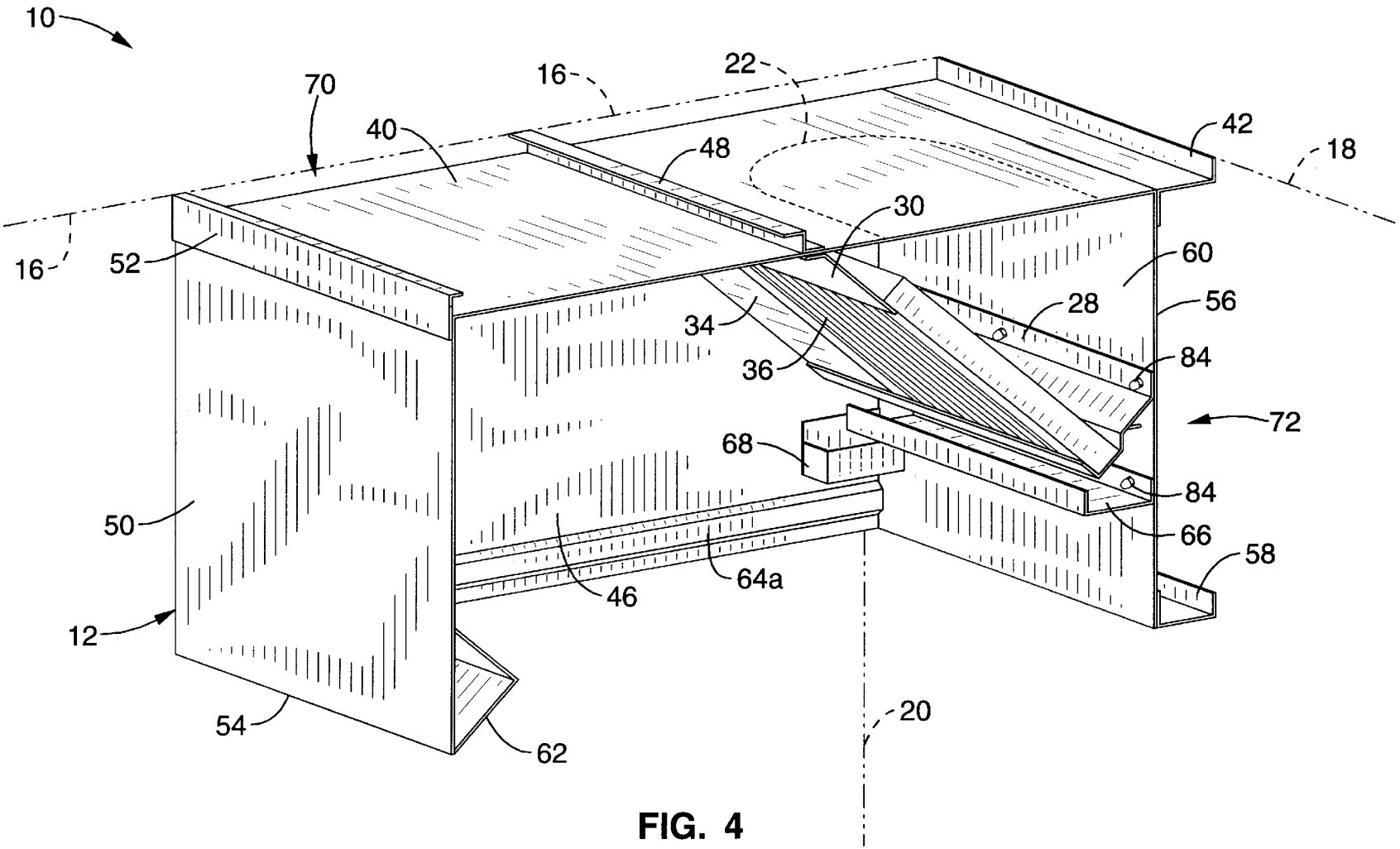
FIG. 4 is an assembled pictorial cross-section of the exhaust hood apparatus of FIG. 3 taken through line 4—4.

FIG. 2 is a plan view of the exhaust hood enclosure 12 in which an exhaust air cutout 38 has been created within the previously described typical duct cutout region 22 within the upper surface 40 of the exhaust hood enclosure 12. An upper rear hanger bracket 42 provides a protrusive mounting bracket which retains the hood enclosure 12 at a distance from the rear wall so as to provide an insulating air space (hidden in this view) between the hood and the rear wall against which the unit is mounted. Exposed hood enclosure side panel 44 is flush mounted to the front and rear panels of the enclosure, whereas hood enclosure side panel 46 is mounted with a recess to provide an insulating space between the interior of the exhaust hood and the side wall. Ridge 48 along the upper surface panel 40 of the hood enclosure 12 is constructed as a vertically protruding channel attached to the upper surface of the exhaust hood to stiffen the top surface span while additionally providing an aid for aligning the top of the exhaust hood with the ceiling. FIG. 3 shows the front face 50 of the hood enclosure 12. Recessed side panel 46 is likewise seen in this view as providing an insulating air-gap. Front hangar bracket 52 is a horizontal mounting bracket extending off the front face 50. The front hangar bracket 52 preferably acts as a both a mounting and facia panel. FIG. 4 illustrates clearly the relationships between the elements as depicted in FIG. 1 through FIG. 3 with the wall-ceiling junctures 16, 18, 20 within this cross-sectional view shown for orientation. An air-gap exists between the upper surface panel 40 of the hood enclosure 12 and the ceiling, as denoted by wall to ceiling junctures 16, 18, this gap is provided by the combination of upper rear hangar bracket 42, ridge 48, and front hangar bracket 52. A lower edge 54 provides a smooth transition from the facing panel 50. Air filters 36 are mounted on their lower ends to the bottom filter retention bracket 28 that is supported by a horizontal row of standoffs (hidden) and attached to the enclosure by fasteners 84. The upper filter retention bracket 30 is shown similarly attached to the enclosure 12. Rear panel surface 56 of the hood enclosure is shown between upper rear hangar bracket 42 and lower rear hangar bracket 58, wherebetween a vertical air-gap 72 exists. Air is drawn through the filters 36 into a plenum area 60 before exiting via the air duct (not shown). The volume of the plenum is substantially sealed from the remainder of the hood such that all air entering the plenum must pass through the filters. A front air deflector 62 and side air deflectors 64*a,* and 64*b* (not shown) deflect the in-rushing air towards the filters 36 for more effective evacuation of fumes from under the exhaust hood. Apparent below the filters 36 are a grease trough 66 and a grease cup 68 which collect grease drippings from the filters 36. A horizontal airspace 70 can be seen between the upper surface panel 40 and a dashed line representing the juncture of the wall and ceiling 16, and a similar insulating airspace is seen in the vertical airspace 72 behind the rear panel 56 of the hood enclosure 12.

Figure 5:
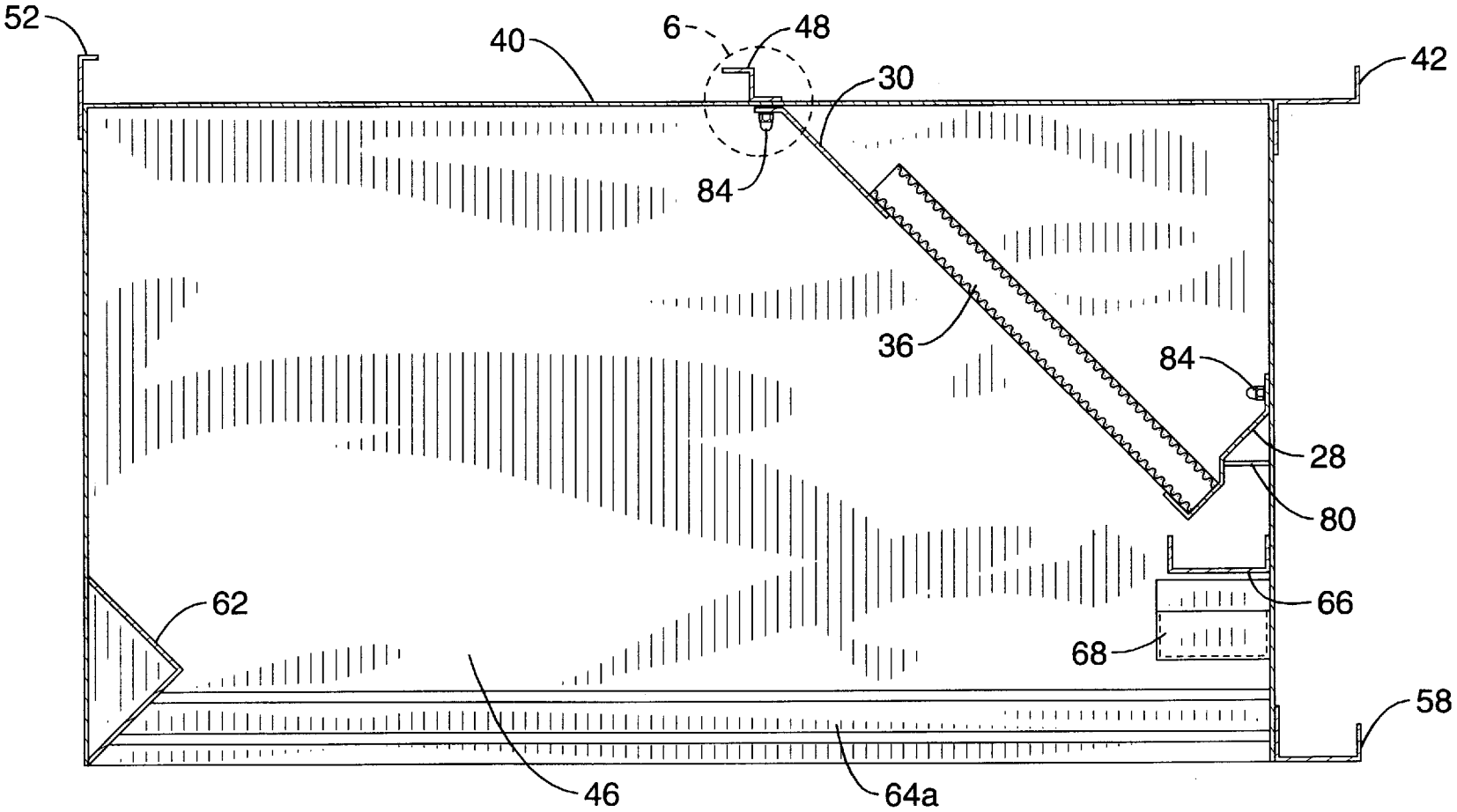
FIG. 5 is a sectional view of the exhaust hood of FIG. 3 taken through line 5—5.
Figure 6:
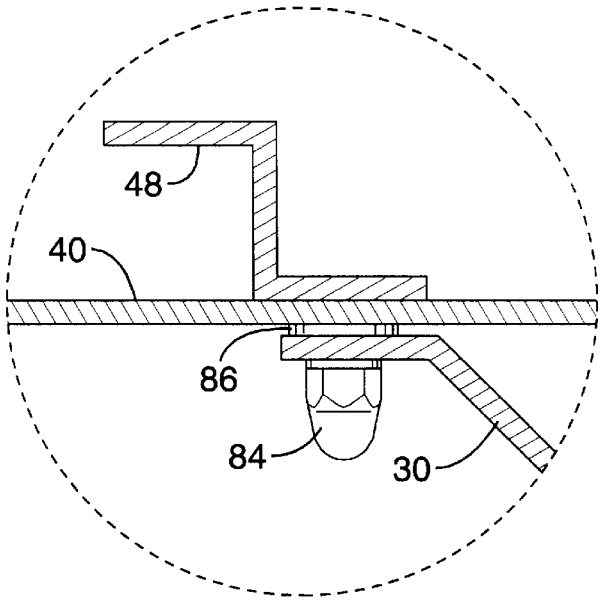
FIG. 6 is an assembled view of retention bracket mounting in the exhaust hood apparatus of FIG. 5.
Figure 7:
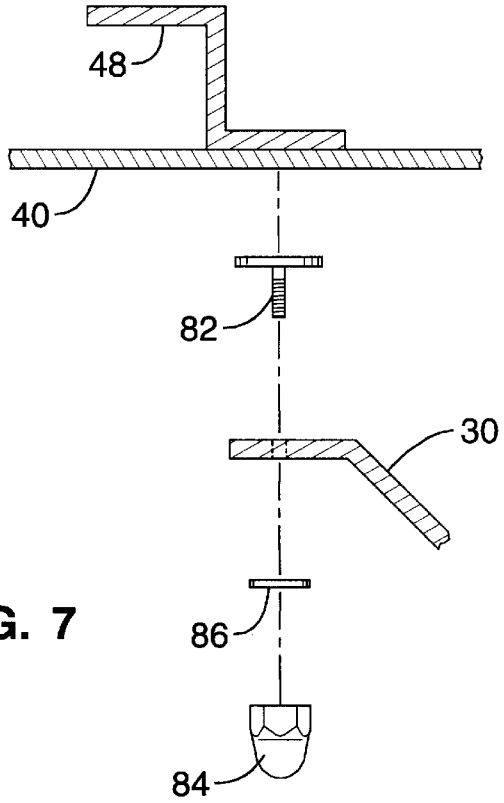
FIG. 7 is an exploded view of the retention bracket mounting of FIG. 6.

FIG. 5 depicts the internals of the exhaust hood in cross section as seen viewed toward the interior of the recessed side panel 46. An air deflector 62 is shown attached to the front edge in cross-section while a side air deflector 64*a* is shown spanning the hood enclosure. The filters 36 are shown mounted on their lower ends to the bottom filter retention bracket 28 that is supported by a horizontal row of standoffs 80 and attached to the enclosure by a row of fasteners 84. The upper filter retention bracket 30 is shown similarly attached to the hood enclosure above which is attached a ridge 48. Below the filter assemblies are seen the grease trough 66 which terminates above a grease cup 68. Hangar brackets 42, 52, and 58 provide air-gaps and mounting attachment points within the hood enclosure. FIGS. 6 and 7 are magnified views of the fasteners used to mount the bracket to the enclosure within this embodiment. FIG. 6 shows a fastener holding the upper filter retention bracket 30 to the top section of the upper surface panel 40 proximal with the ridge 48 of the hood enclosure. An acorn PAL nut fastener 84, backed by washer 86, is threaded over the welded stud protruding from the hood enclosure. FIG. 7 shows the elements from FIG. 6 in separation, including an individual stud 82, shown prior to being welded to the interior of the upper surface panel 40. Each standoff (not shown) within the horizontal row of standoffs 80 are similarly threaded onto a threaded stud fastened to the hood enclosure to provide support for the bracket.

The exhaust hood is designed to allow for easy installation, so as not to entail the creation of complex drawings by the installer or the need for a factory made custom duct work connection to the exhaust hood. The exhaust hood of the invention is designed so that the installer may cut the duct hole as part of the installation process. FIG. 8 through FIG. 16 illustrate the addition of exhaust hood structures to a bare hood enclosure as may be performed in the field. The exhaust hood within this series of figures is shown on its side so that the structures can be seen more readily, although in the field the unit is to be installed in its correct operating orientation. During the installation process the installer may cut the duct hole in the exhaust hood at any time prior to the final steps of attaching the upper filter retention brackets and filters. The cutout for the connection to the exhaust duct and the welding thereof is not depicted as this operation is performed at any time during the installation process and the duct cutout can be located at any location within the plenum area of the exhaust hood.

Figure 8:
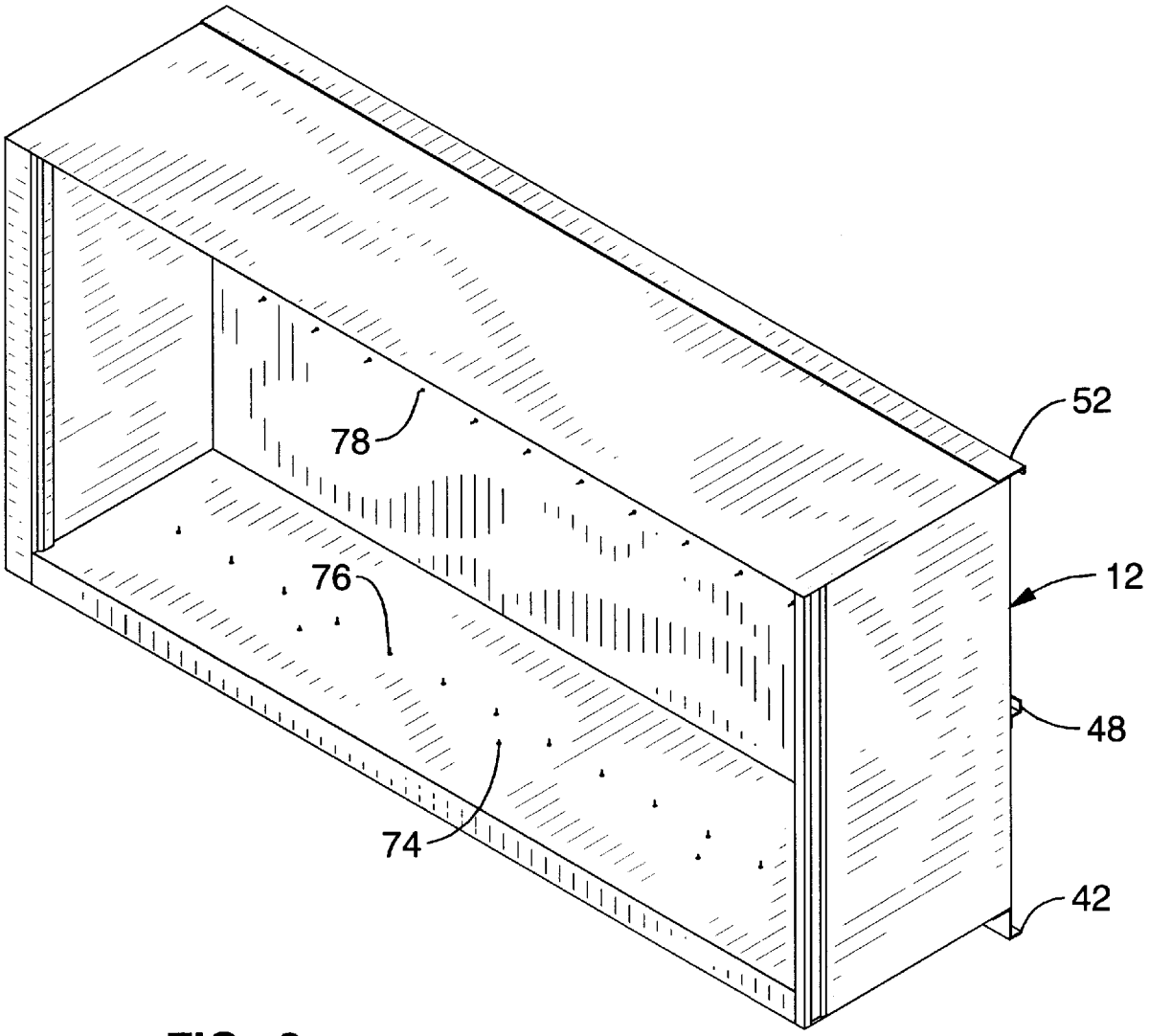
FIG. 8 is a perspective view of a bare exhaust hood apparatus according to the invention.
Figure 9:
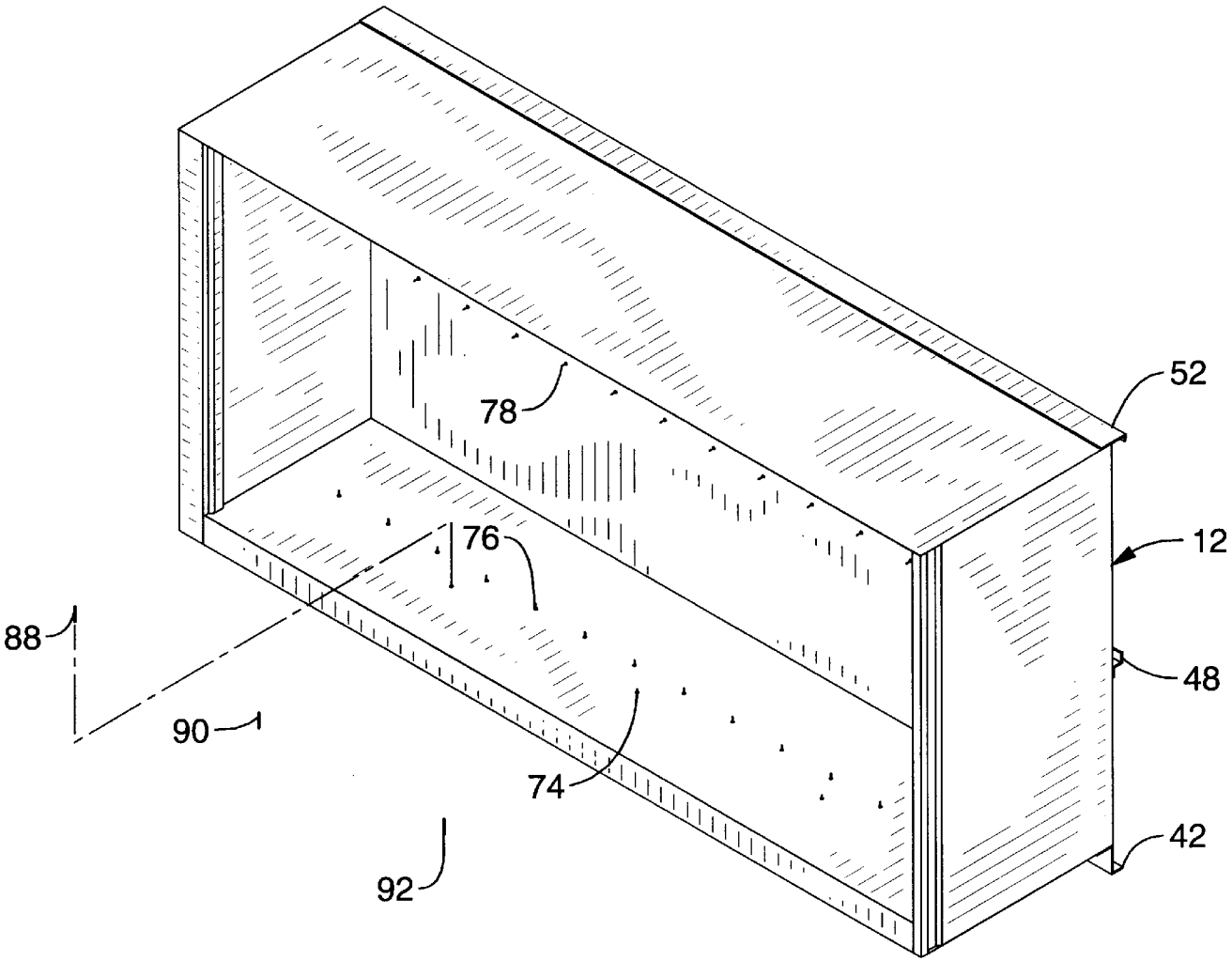
FIG. 9 is a partially-exploded view of the exhaust hood apparatus of FIG. 8, showing installation of standoffs.
Figure 10:
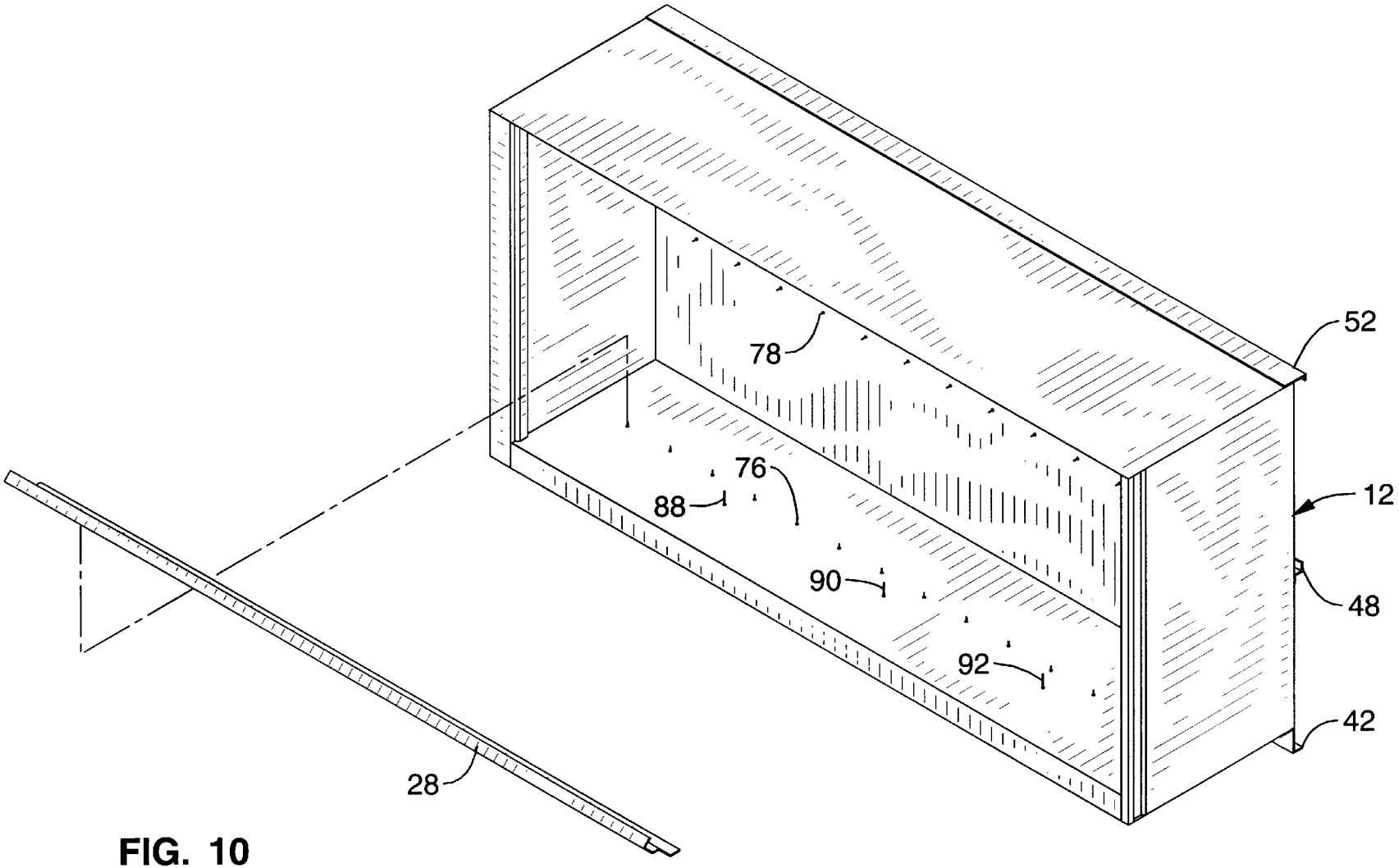
FIG. 10 is a partially-exploded view of the exhaust hood apparatus of FIG. 9, showing installation of the lower filter retention bracket.
Figure 11:
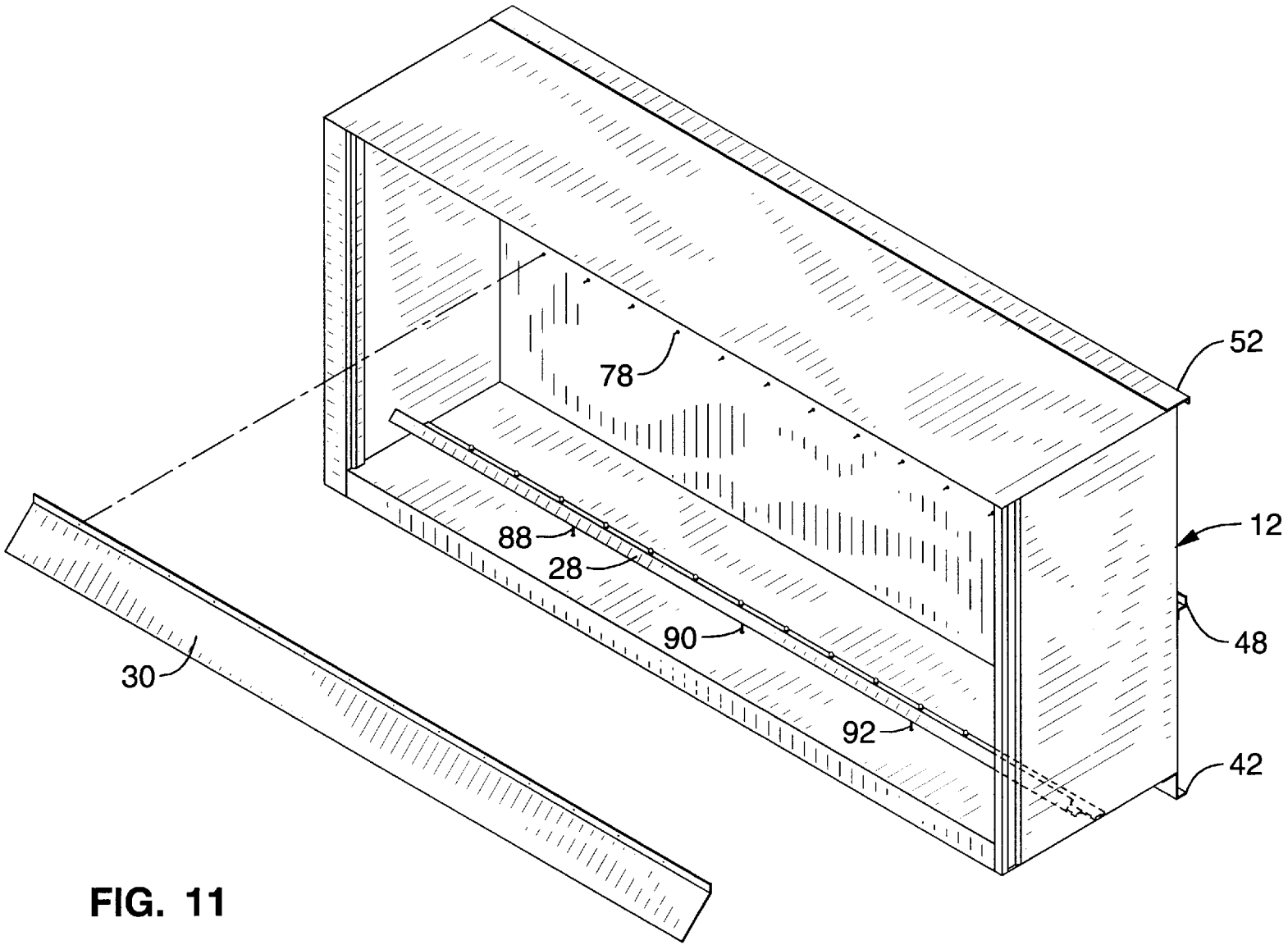
FIG. 11 is a partially-exploded view of the exhaust hood apparatus of FIG. 10, showing installation of upper filter retention bracket.
Figure 12:
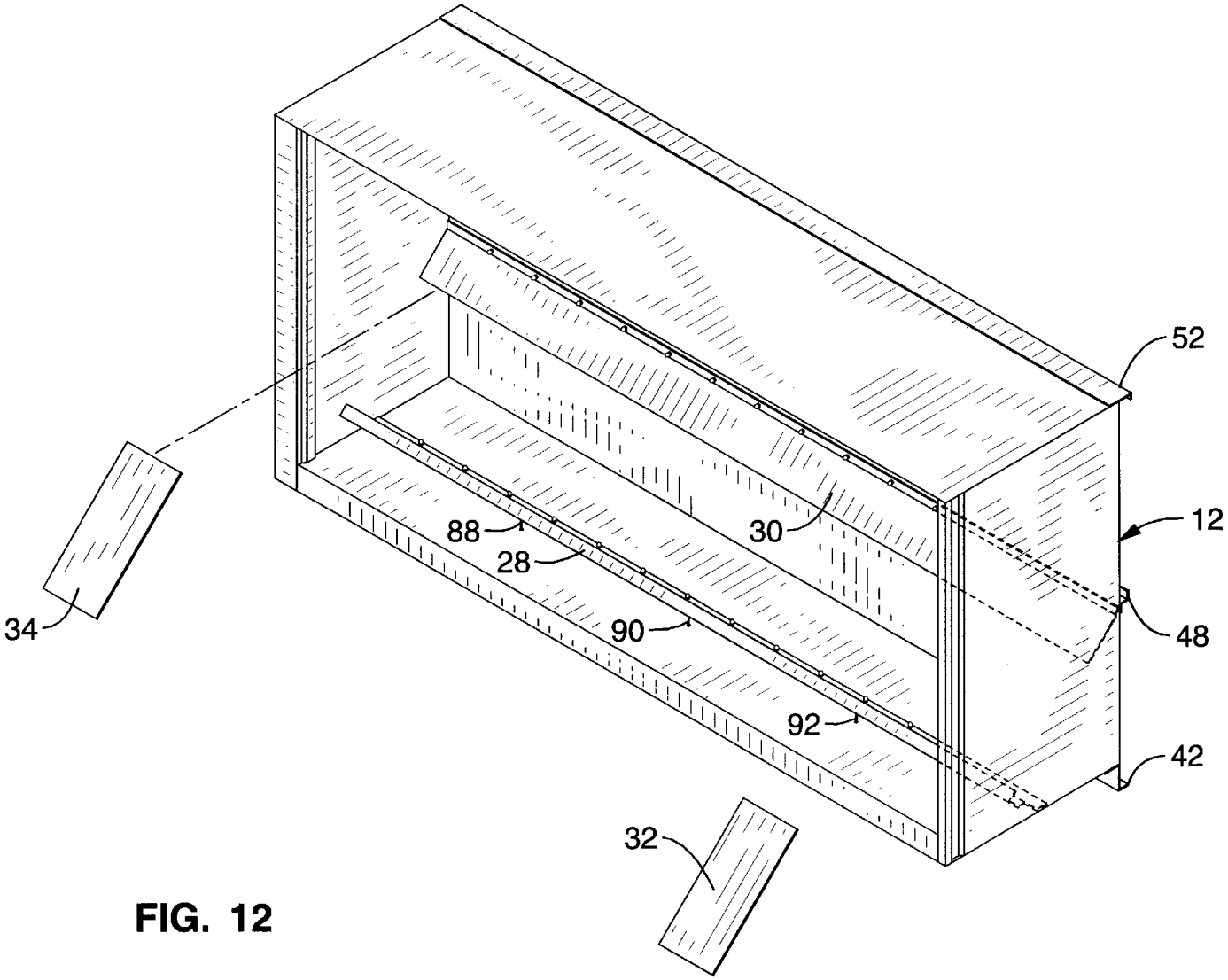
FIG. 12 is a partially-exploded view of the exhaust hood apparatus of FIG. 11, showing installation of the right and left side panels.
Figure 13:
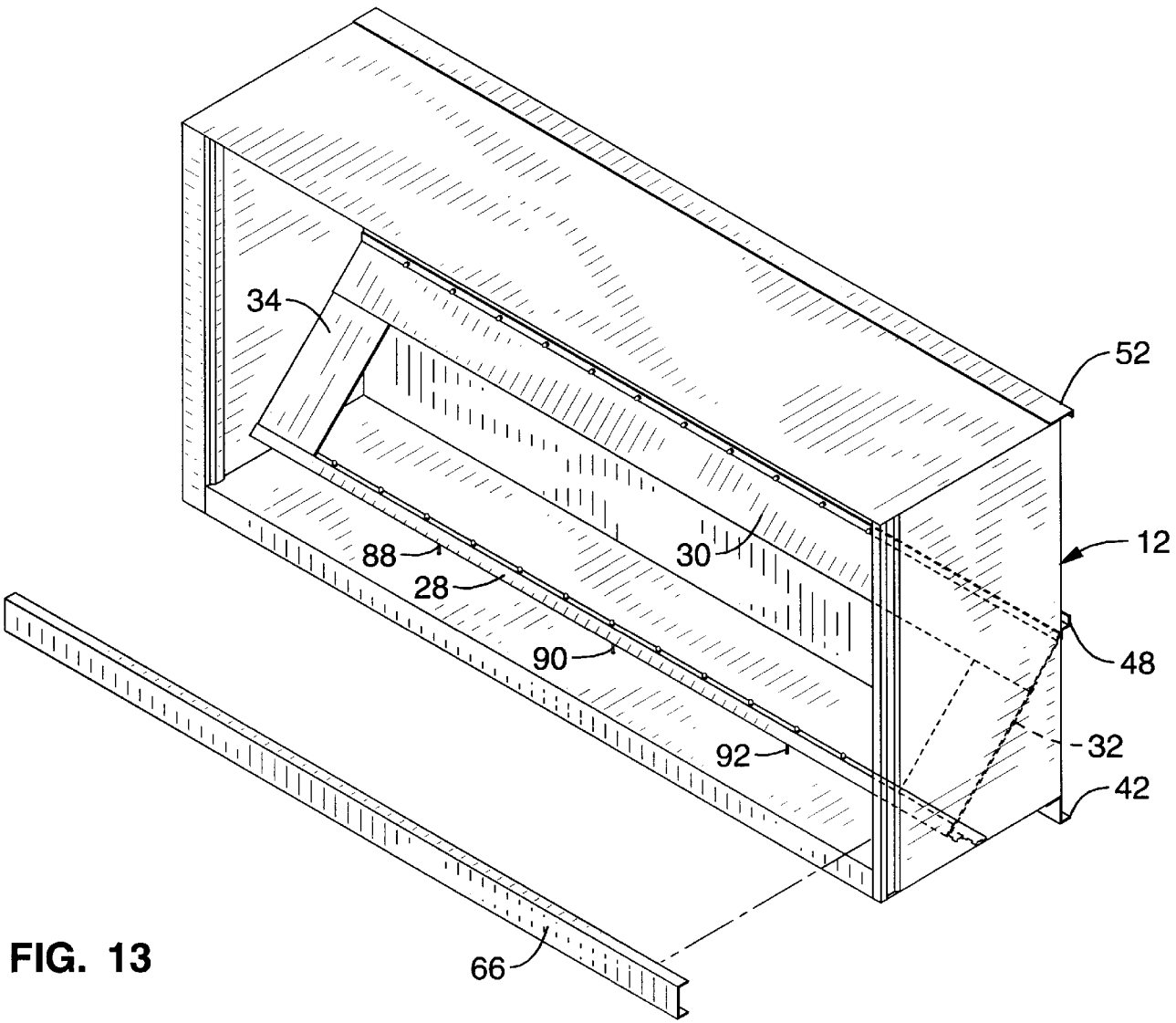
FIG. 13 is a partially-exploded view of the exhaust hood apparatus of FIG. 12, showing installation of the grease trough.
Figure 14:
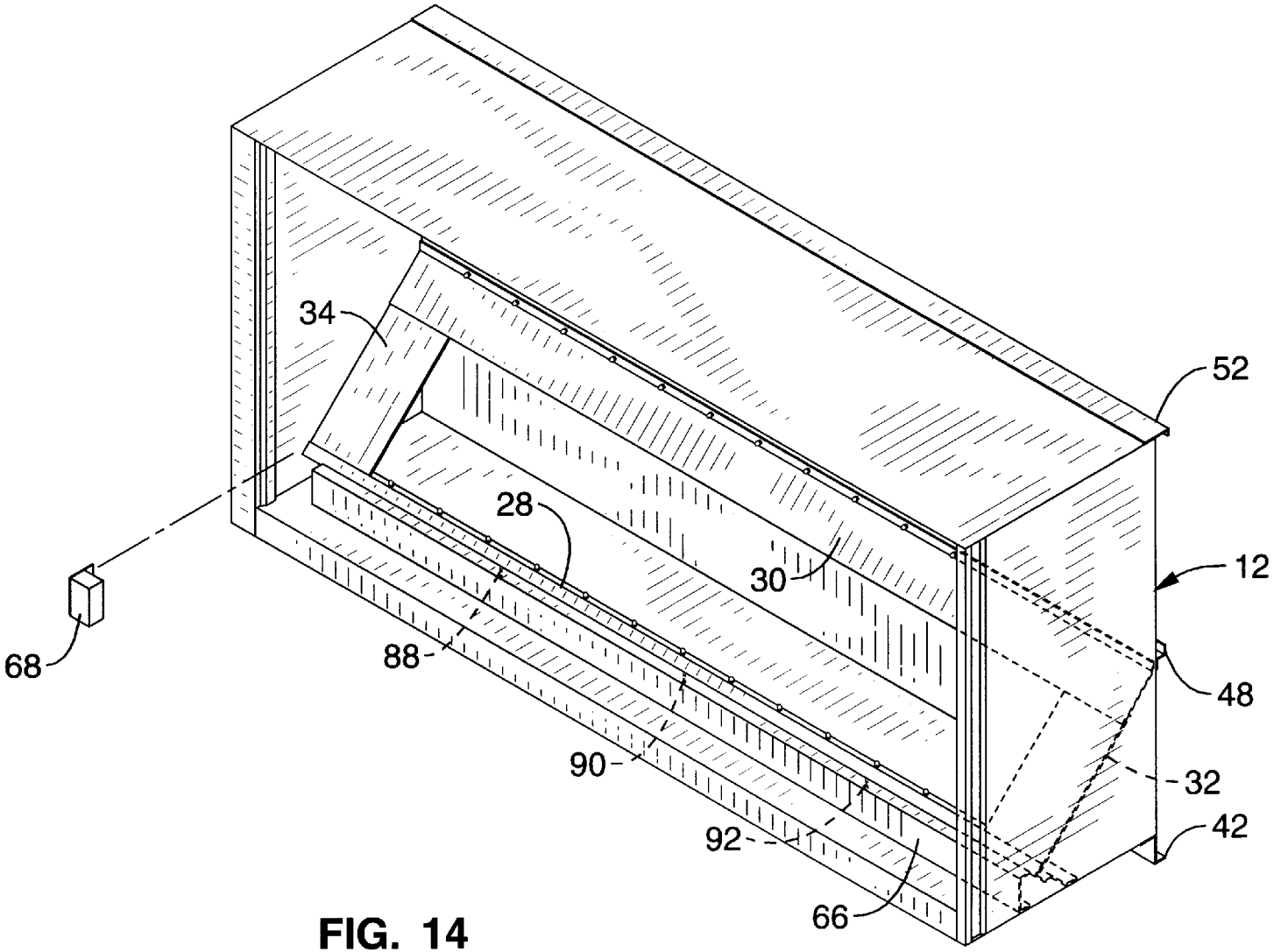
FIG. 14 is a partially-exploded view of the exhaust hood apparatus of FIG. 13, showing installation of the grease cup.
Figure 15:
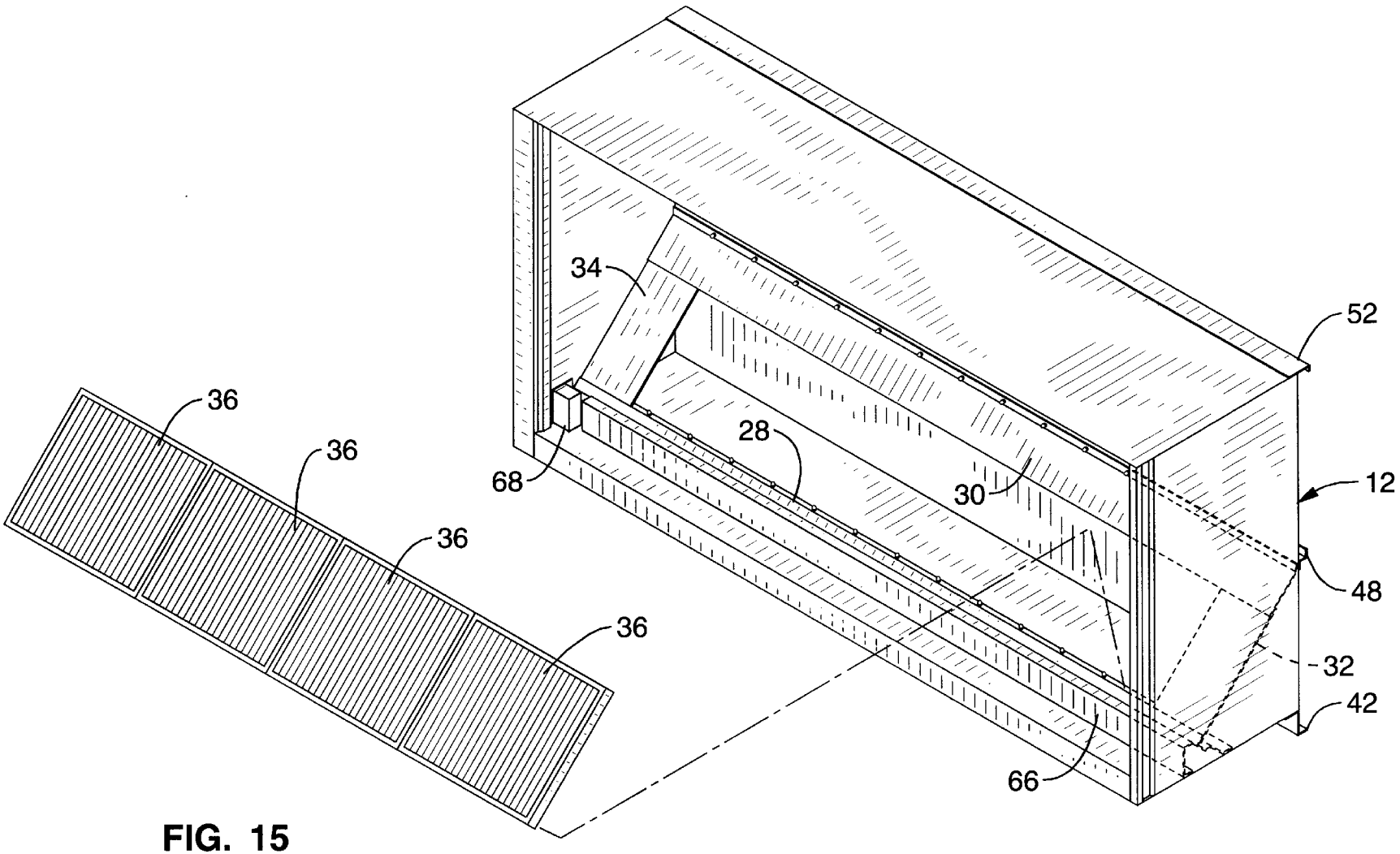
FIG. 15 is a partially-exploded view of the exhaust hood apparatus of FIG. 14, showing air filter installation.
Figure 16:
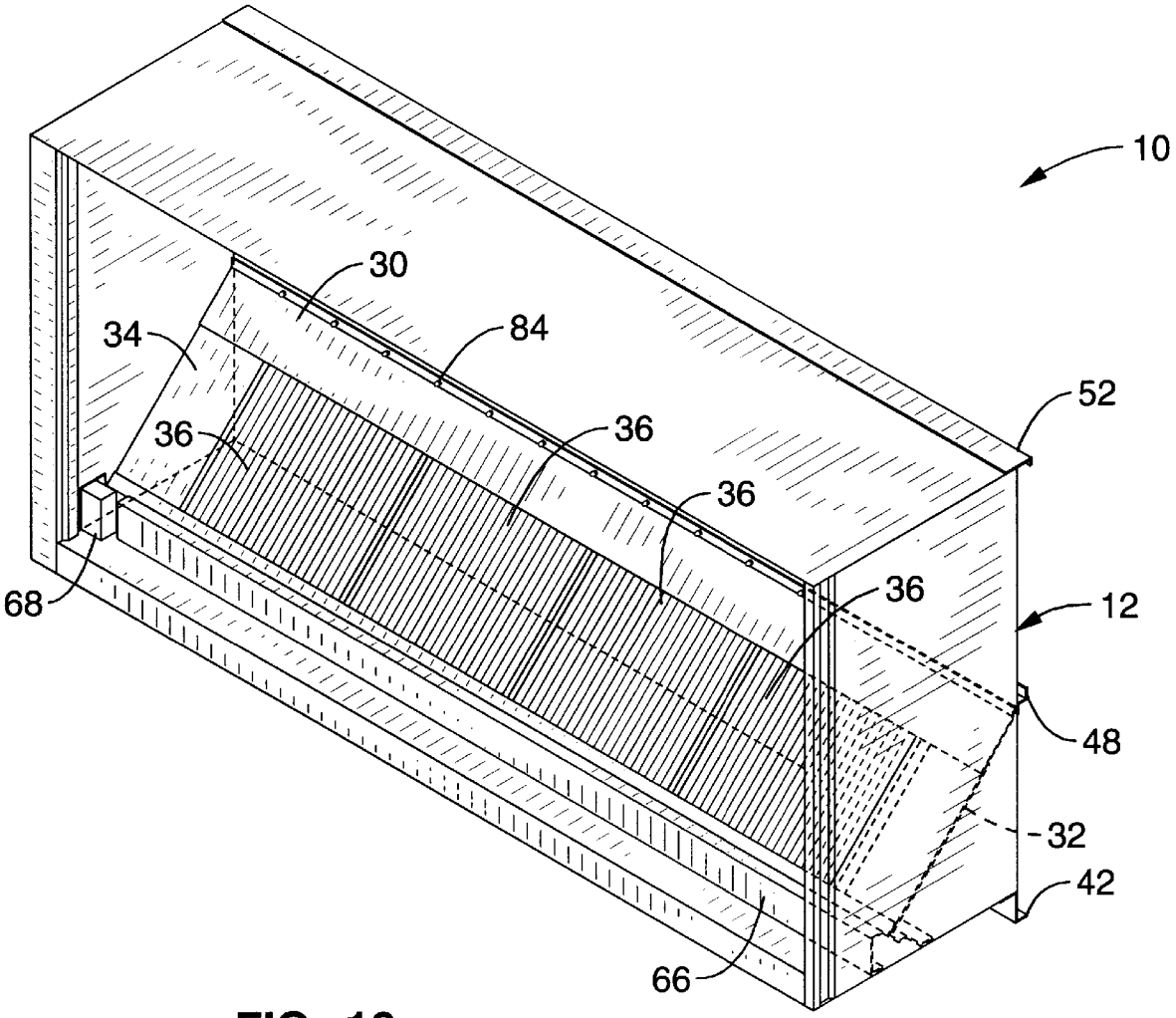
FIG. 16 is a perspective view of the assembled exhaust hood apparatus.

FIG. 8 depicts the exterior of the bare exhaust hood which is factory configured with a horizontal row of mounting. Studs 74 used for mounting spacers, a lower horizontal row of bracket mounting studs 76 for fastening the lower filter retention bracket 28 to the hood, and an upper horizontal row of bracket mounting studs 78 for fastening the upper filter retention bracket 30 to the hood. It should be recognized that additional mounting studs can be included for the mounting of additional parts or assemblies thereto. FIG. 9 shows installation of standoffs 88, 90, 92 to the horizontal row of standoff mounting studs 74. In FIG. 10 the installation of the lower filter retention bracket 28 to the lower horizontal row of bracket mounting studs 76 is shown. The standoffs 88, 90,92 support this lower filter retention bracket 28. Preferably the lower retention bracket is pre-assembled within the exhaust hood, though it may be removed if additional clearance is required for creating a duct cutout and welding of the duct to the enclosure 12. It is anticipated that in the majority of installations, the creation of the aperture to accommodate the air duct and the subsequent welding of the hood enclosure 12 to the air duct (not shown) would be performed at this stage, prior to further assembly. In FIG. 11 the upper filter retention bracket 30 is installed to the upper horizontal row of bracket mounting studs 78. FIG. 12 illustrates the installation of the blocking panels comprising right side panel 32 and left side panels 34 which are attached between the upper filter retention bracket 30 and the lower filter retention bracket 28. The side panels block air from passing between the sides of the filters and interior of the exhaust hood. FIG. 13 depicts the installation of the grease trough 66. FIG. 14 shows the installation of the grease cup 68. FIG. 15 shows the installation of the air filters 36. FIG. 16 illustrates the fully assembled exhaust hood (shown on its side for clarity). It can be easily recognized from the foregoing discussion that the present invention allows the installation process to be performed in a single process without the necessity of creating custom drawings or manufacturing a custom duct collar.

The described embodiment is preferably fabricated of 18 gauge type 304 polished stainless steel sheet metal. The unexposed exhaust plenum is preferably fabricated from either 16 gauge steel or may be made from stainless steel. All exterior seams are continuously welded to be liquid tight and are ground smooth to the exterior finish. The filter retainers are built to house a series of UL listed 16"×20"×2" baffle type filters, although the inventive apparatus can be configured in various sizes and house a variety of filters.

Figure 18:
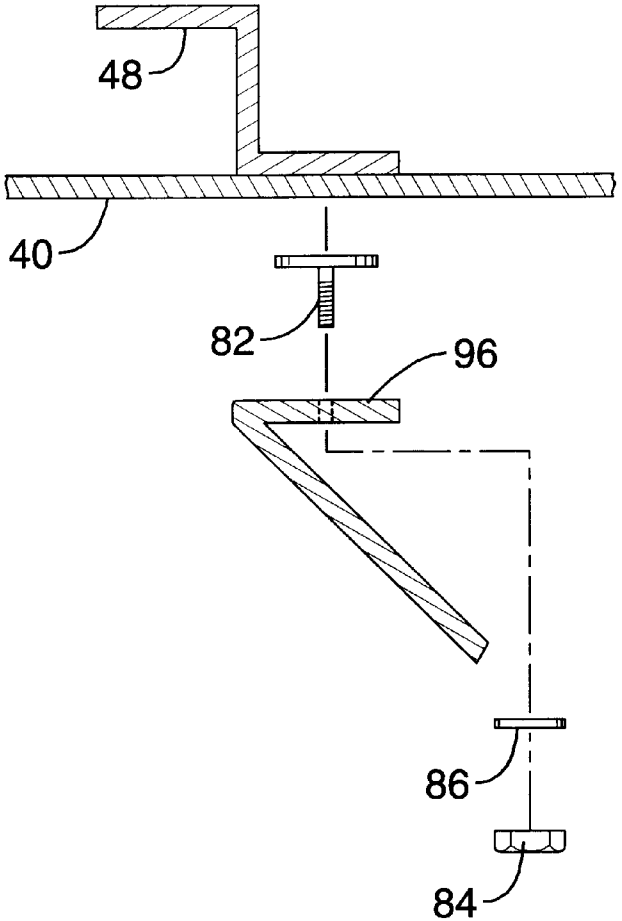
FIG. 18 is an exploded view of the retention bracket mounting of FIG. 17.
Figure 17:
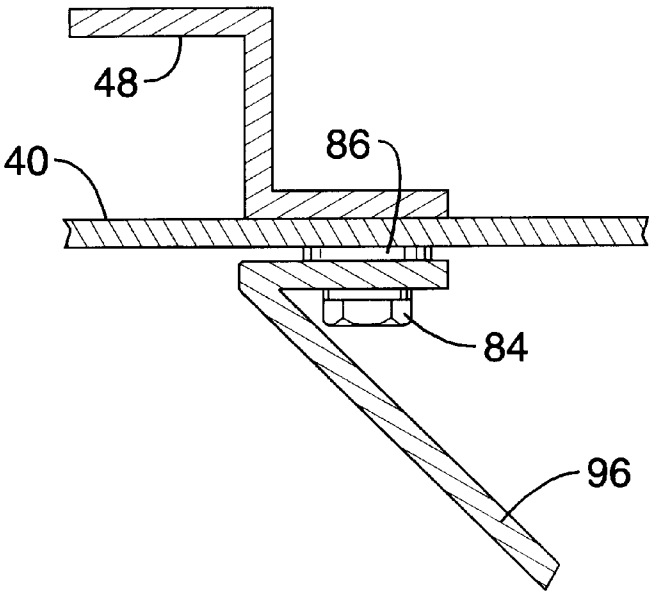
FIG. 17 is an assembled view of a retention bracket mounting according to another embodiment of the invention.

FIG. 17 and FIG. 18 show an alternative configuration of the upper filter retention bracket 94 shown connected with upper surface panel 40 by a stud 82 and retained by washer 86 and nut 84. This configuration of the retention bracket performs an identical function as that described for FIG. 1. through FIG. 16. However, it provides for concealment of the retention nuts 84 within the plenum area of the exhaust hood which improves the appearance and facilitates cleaning. It will be appreciated that the components of the exhaust hood can be fabricated with variations as to location, shape and methods of attachment without departing from the inventive principles.

A nominal installation process of the preferred embodiment is performed as follows: The exhaust hood is test fit within the its target location on the supporting structure and marked as to how it fits the air duct. An aperture for exhausting air into the mated ductwork is then created, preferably by cutting. The exhaust hood is attached to the building structure and the exhaust duct is welded to the exhaust hood. The upper filter retention bracket is mounted to the hood, followed by air filter mounting and side panel attachment. The grease trough and grease cup are thereafter attached.

Accordingly, it will be seen that this invention provides an easy to install exhaust hood that eliminates the need for both duct fit drawings and for custom factory collar installation. Although the description above contains many specificities, these should not be construed as limiting the scope of the invention but as merely providing illustrations of some of the presently preferred embodiments of this invention. Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for collecting and filtering exhaust fumes and routing them to an attached air duct, comprising:

(a) an exhaust hood capable of being affixed to a support structure and containing a plurality of attachment points;

(b) filter retention members capable of retaining at least one air filter and of being attached within said exhaust hood at said attachment points by a plurality of fasteners;

(c) means for providing fluid communication and attachment between the exhaust hood and the air duct during installation so that exhaust fumes may be passed therethrough, said means not requiring the use of a factory installed air duct aperture or connector; and (d) a grease trough configured for attachment to said attachment points within the exhaust hood during installation.

2. An apparatus as recited in claim 1, wherein said means for providing fluid communication and attachment is provided by the creation of an aperture in the exhaust hood and the affixing of the exhaust hood to the air duct, installation thereafter including the attachment of said filter retention members and filters thereof whose presence earlier may have interfered with the process of aperture creation and affixing of the exhaust hood to the air duct.

3. An apparatus as recited in claim 1, wherein threaded studs have been welded to the interior of the exhaust hood to provide said attachment points.

4. An industrial exhaust hood for exhausting fumes through a filter and into an air duct, comprising:

(a) a hood enclosure having at least a portion of one face open to collect exhaust fumes and configured for attachment to a supporting structure and an associated air duct, the hood enclosure having a plurality of preconfigured attachment points, and capable of being configured at the time of installation with an air-flow aperture for connection to the air duct as no factory created aperture exists within the hood enclosure which is configured for the particular air duct;

(b) an insertable filter retention member configured for retaining at least one air filter through which exhaust fumes are passed, said filter retention member capable of being attached to the hood enclosure at said preconfigured attachment points with fasteners after the fitting and attachment of said hood enclosure to the air duct; and (c) a grease trough capable of being attached at said preconfigured attachment points and retained by fasteners thereupon.

5. An industrial exhaust hood as recited in claim 4, further comprising a grease cup capable of being attached beneath said grease trough.

6. An industrial exhaust hood as recited in claim 4, wherein said filter retention member comprises an upper filter retainer and a lower filter retainer wherebetween said air filters are retained.

7. An industrial exhaust hood as recited in claim 4, further comprising blocking panels configured for attachment to cover air gaps so that air is prevented from entering the air duct without first passing through the filters of the exhaust hood.

8. An industrial exhaust hood as recited in claim 4, wherein said fasteners comprise threaded nuts retained on threaded shafts.

9. An industrial exhaust hood as recited in claim 8, wherein said threaded shafts are contained on studs which are welded to the hood enclosure.

10. An industrial exhaust hood as recited in claim 4, further comprising standoffs which protrude from the exterior of said hood enclosure to create air-gaps between said hood enclosure and adjoining structures.

11. An industrial exhaust hood as recited in claim 10, wherein upper front and upper rear hanger brackets extend vertically above the hood enclosure to provide said standoffs.

12. An industrial exhaust hood as recited in claim 4, wherein a channel section protruding rearwardly from said hood enclosure provides a standoff for creating an air-gap between said hood enclosure and adjoining structures.

13. An industrial exhaust hood as recited in claim 4, wherein at least one side panel is recessed within the hood enclosure to create an air-gap between said side panel and the adjoining structure.

14. An industrial exhaust hood as recited in claim 4, further comprising at least one air deflector mounted horizontally on a lower portion of at least one vertical interior face within said hood enclosure for deflecting air towards the air filters.

15. An industrial exhaust hood as recited in claim 4, wherein said enclosure is fabricated primarily of stainless steel sheet metal.

16. An industrial exhaust hood as recited in claim 4, wherein filter retainers are built to house a series of UL listed baffle type filters.

17. An industrial exhaust hood for exhausting fumes through a filter and into an air duct, comprising:

(a) a hood enclosure having at least a portion of one face open to collect exhaust fumes and configured for attachment to a supporting structure and an associated air duct, the hood enclosure having a plurality of preconfigured attachment points, and capable of being configured at the time of installation with an air-flow aperture for connection to the air duct as no factory created aperture exists within the hood enclosure which is configured for the particular air duct;

(b) an insertable filter retention member configured for retaining at least one air filter through which exhaust fumes are passed, said filter retention member capable of being attached to the hood enclosure at said preconfigured attachment points with fasteners after the fitting and attachment of said hood enclosure to the air duct; and (c) standoffs which protrude from the exterior of said hood enclosure to create air-gaps between said hood enclosure and adjoining structures;

(d) wherein upper front and upper rear hanger brackets extend vertically above the hood enclosure to provide said standoffs.

* * * * *